United States Patent [19]

Whitfield

[11] Patent Number: 4,716,608

[45] Date of Patent: Jan. 5, 1988

[54] MATTRESS COVER HOLDER

[76] Inventor: John H. Whitfield, P.O. Box 54, Laytonville, Calif. 95454

[21] Appl. No.: 884,932

[22] Filed: Jul. 14, 1986

[51] Int. Cl.[4] ..... A47C 21/02

[52] U.S. Cl. ..... 5/451; 5/498; 5/508; 24/72.5

[58] Field of Search ..... 5/498, 496, 451, 482, 5/508; 24/72.5

[56] References Cited

U.S. PATENT DOCUMENTS

| | | | |
|---|---|---|---|
| 524,834 | 8/1894 | Mayent | 5/498 |
| 777,016 | 12/1904 | France . | |
| 2,459,497 | 1/1949 | Calabro | 24/72.5 |
| 3,858,256 | 1/1975 | Beer . | |
| 4,040,133 | 8/1977 | Gilreath . | |
| 4,100,632 | 7/1978 | Johnson . | |
| 4,222,139 | 9/1980 | Svedberg-Recker et al. | 5/402 |
| 4,228,555 | 10/1980 | Katzakian | 5/451 |
| 4,245,364 | 1/1981 | Calleance | 5/451 |
| 4,279,061 | 7/1981 | Santo | 5/451 |
| 4,301,561 | 11/1981 | McLeod | 5/496 |
| 4,413,367 | 11/1983 | Miller et al. | 5/451 |
| 4,488,323 | 12/1984 | Colburn | 5/451 |
| 4,494,262 | 1/1985 | Robertson | 5/451 |
| 4,506,398 | 3/1985 | Hruban | 5/451 |
| 4,535,496 | 8/1985 | Parker | 5/451 |
| 4,541,137 | 9/1985 | Murray | 5/451 |

FOREIGN PATENT DOCUMENTS

| | | | |
|---|---|---|---|
| 2513955 | 10/1976 | Fed. Rep. of Germany | 5/498 |
| 558402 | 1/1944 | United Kingdom | 24/72.5 |

*Primary Examiner*—Alexander Grosz

*Attorney, Agent, or Firm*—Beveridge, DeGrandi & Weilacher

[57] ABSTRACT

An apparatus for releasably securing a mattress cover or bedclothes to a mattress or bed, including a generally rectangular anchoring device to be positioned below the sleeping surface of the mattress, and fastening members for connecting the anchoring device to a mattress cover or other bedclothes. Each fastening member has a protective cover for protecting the mattress and/or the bed frame from damage from the fastening member. In one embodiment, the anchoring device is a continuous member, while in another embodiment the anchoring member is formed of at least two relatively movable members, with clamps, carried on the movable members, that releasably lock such members together to fit the size and shape of the mattress.

10 Claims, 5 Drawing Figures

MATTRESS COVER HOLDER

BACKGROUND OF THE INVENTION

The present invention relates to apparatus for securing bedclothes on a mattress. More particularly, the present invention pertains to an apparatus which cooperates with a mattress to secure bedclothes thereon without damaging the mattress and/or the bed frame. While the present invention is particularly suited for use with a fluid-filled mattress or waterbed, it is likewise usable with a conventional mattress.

Securing of bedclothes on a bed to ensure comfort has long been a problem the solution to which has been an objective in the prior art. U.S. Pat. No. 777,016 discloses a representative appliance for this purpose, including a strap sewn to the bedclothes. Loops depend from the strap and carry fasteners. The fasteners, in turn, connect with eyes or rings depending from the bedframe to secure the bed coverings.

U.S. Pat. No. 4,506,398 states that with the increase in popularity of waterbeds, further problems are encountered in securing the bedclothes to the mattress. Since a waterbed mattress is a flexible, fluid-filled vessel, that patent concludes that some earlier devices, which are relatively effective with more rigid, conventional mattresses, are ineffective on waterbeds. To overcome this stated deficiency, the patent discloses a generally rectangular waterbed sheet including hemmed pockets along its sides but not its corners. Each pocket is adapted to telescopically receive a rigid member in the form of a rod that in use is gripped between the walls of the bedframe and bladder-mattress to prevent movement of the sheet. Thus, the sheet must be particularly dimensioned to properly drape over the mattress to ensure that the rods are gripped at the desired point between the mattress and the bedframe walls.

U.S. Pat. No. 4,100,632 discloses a sheet having hems at its headboard and footboard ends. Rods extend through the hems and fit into any of several slots in each of two adjusting plates mounted on the headboard and footboard of the bed.

U.S. Pat. No. 4,494,262 shows a waterbed mattress cover having elastomeric bands that extend across the corners of the bladder and expand and/or contract with the bladder to accommodate displacement of the water.

U.S. Pat. Nos. 4,040,133 and 4,488,323 are typical of patents disclosing hook and loop, or Velcro type fasteners for holding bedclothes to a mattress.

SUMMARY OF THE INVENTION

The apparatus for securing bedclothes to a bed in accordance with the present invention accommodates any conventional mattress cover for making the bed. Thus, the need for specially configured or specially sewn bedclothes is avoided. Moreover, the apparatus, according to the present invention, requires cooperation only with the mattress; no cooperation with the bed frame is necessary to firmly hold the mattress cover and other bedclothes. The apparatus includes a continuous anchoring device contacting the mattress below the plane of the sleeping surface. In accordance with a preferred embodiment of the present invention, the anchoring device is adapted to snugly engage anywhere along the sides of the mattress. Alternatively, the anchoring device may be disposed underneath the mattress to perform the same function in an effective way.

In one preferred embodiment of the apparatus, the anchoring device includes two or more members which, together, are particularly adapted to engage the sidewalls of the mattress along the mattress perimeter. The members are movable with respect to one another to assume the dimensions of the mattress. Clamps are provided to releasably fix the elements together to prevent further movement thereof and thereby to secure the bedclothes. Fastening members, depending from the anchoring device, ensure facilitated fastening of the bedclothes to the anchoring device. A protective member is provided for each of the fastening members. The protective members, when so installed, shield the mattress and/or the bed frame from damage by the anchoring devices.

BRIEF DESCRIPTION OF THE DRAWINGS

These and other aspects and advantages of the present invention are more apparent from the following detailed description and claims, particularly when considered in conjunction with the accompanying drawings in which like parts bear like reference numerals. In the drawings:

DETAILED DESCRIPTION OF THE PREFERRED EMBODIMENTS OF THE INVENTION

Figure 1:
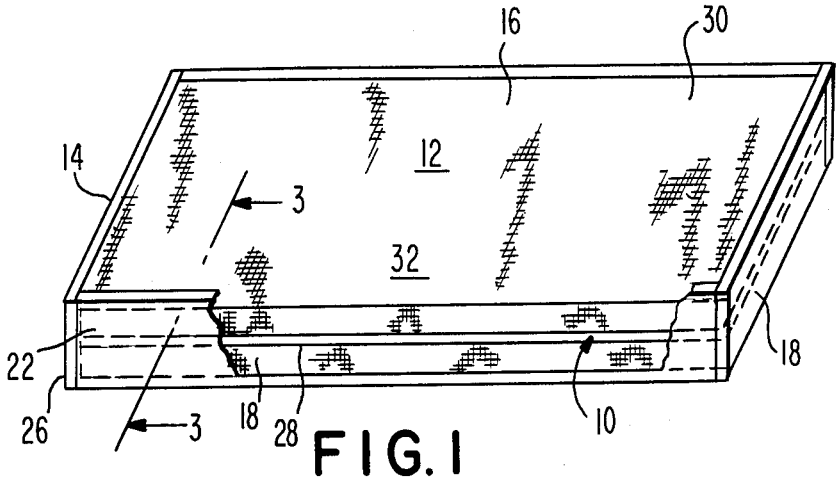
FIG. 1 is a fragmentary, partially cut-away perspective view of a bed with a mattress and an apparatus for securing the bedclothes to the mattress in accordance with the present invention.

FIG. 1 is a perspective view of a first preferred embodiment of an apparatus 10 for releasably securing bedclothes to a bed. Apparatus 10 is shown as cooperating with mattress 12 of a bed 14. Exemplary bed 14 is of the waterbed type and thus mattress 12 contains fluid to support persons or objects lying on the mattress. Alternatively, bed 14 could be any conventional bed.

Figure 3:
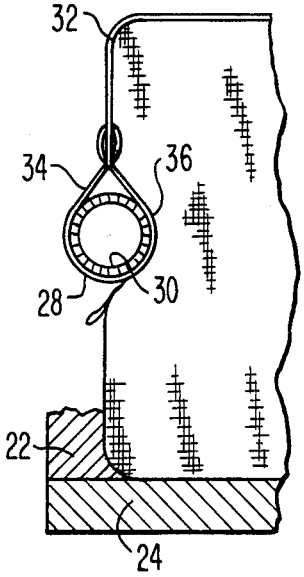
FIG. 3 is an enlarged, fragmentary sectional view taken generally along line 3—3 of FIG. 1.
Figure 4:
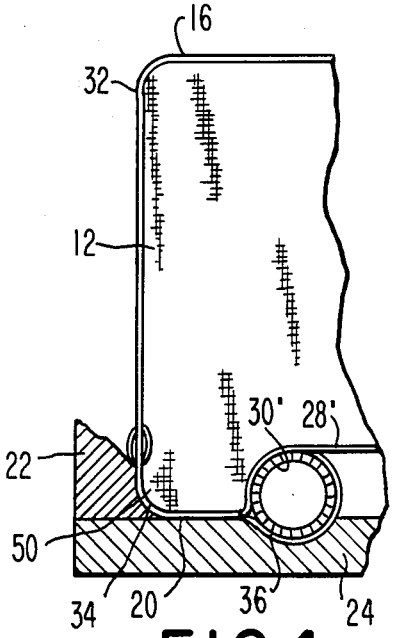
FIG. 4 is a view, similar to FIG. 3, of an alternative embodiment of the apparatus in cooperation with the underside of a mattress.

Mattress 12 has an upper sleeping surface 16, side and end surfaces 18, and a bottom surface 20, shown in FIGS. 3 and 4. As is appreciated, side and end surfaces 18 and bottom surface 20 contact respectively side structure 22 and base 24 of bed frame 26 so that mattress 12 rests within the enclosure of frame 26.

Figure 2:
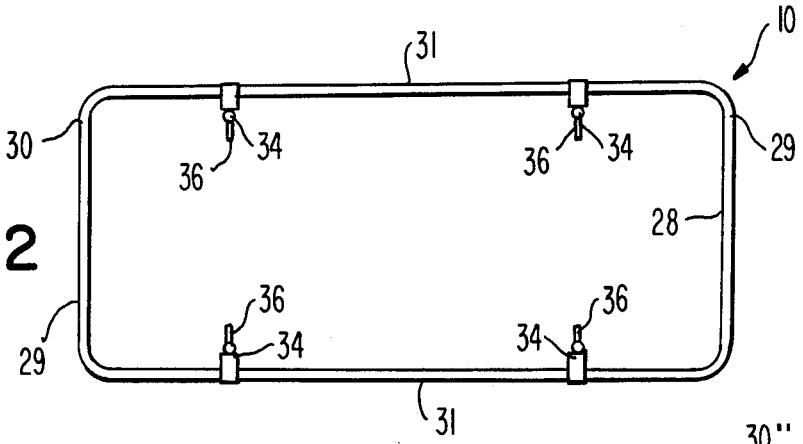
FIG. 2 is a top plan view depicting components of the apparatus of FIG. 1.

With reference to both FIG. 1 and FIG. 2, apparatus 10 includes a continuous, rectangular anchoring device 28. Anchoring device 28 includes a pair of end portions 29 and a pair of side portions 31 so that the anchoring device extends as one continuous element. Anchoring device 28 is preferably formed as a continuous band, rod or the like which encircles mattress 12 along the outer sidewalls thereof. In FIGS. 3 and 4, anchoring device 28 is shown as a continuous tubular member 30. Anchoring device 28 may be fabricated from metal, plastic or other material to have sufficient strength to constrict mattress side and end surfaces 18 as shown in detail in FIG. 3. Thus, in the embodiment of FIG. 3, anchoring device 28 has inner dimensions somewhat smaller and adjustable than the perimeter of mattress 12 so that the anchoring device cooperates with mattress 12 to be held in place around the mattress at a point below sleeping surface 16.

To secure mattress cover 32, or any other bedclothes to bed 14, apparatus 10 includes several fasteners 34 which extend from anchoring device 28 and clip to mattress cover 32 in order to secure the cover to the anchoring device. Fasteners 34 preferably comprise standard, snap fasteners so that connection of cover 32 to anchoring device 28 is quickly and easily accomplished. Alternatively, the fasteners could comprise interlocking male and female elements, commercially available as Velcro fasteners, positioned respectively on the cover and on a fabric piece. However, such an embodiment would require slight modification to the cover to install several such elements thereon, as by installing the velcro snap on the mattress cover or sheet.

Fasteners 34 are shown in FIG. 3 to have protective means 36 thereon which protect mattress 12 from frictional damage or the like that could be imparted to mattress 12 by anchoring device 28. Protective means 36 likewise protects the bedframe from damage. Protective means 36 can be of any suitable material such as cloth.

FIG. 4 shows anchoring device 28' formed as a continuous tubular member 30' disposed underneath mattress 12. In position beneath mattress 12, member 30' is firmly held between mattress 12 and base 24 of bed frame 26 by the weight of mattress 12. Fasteners 34 extend around the bottom edge 50 of mattress 12 to grip mattress cover 32. As previously described, protective means 36 protect mattress 12 and base 24 from damage by anchoring device 28'.

Anchoring device 28' may be positioned anywhere below sleeping surface 16 of mattress 12. Anchoring device 28 or 28' snugly engages either around sides 18 of mattress 12 or against the bottom surface 20 thereof so that the anchoring device is secured in a position to, in turn, secure the mattress cover. The cooperation of anchoring device 28 or 28' and the mattress retains the anchoring device in the desired position. No cooperation with the bed frame is necessary. When anchoring device 28 or 28' is so positioned, fasteners 34 are all that is needed to secure the mattress cover to the anchoring device and therefore to the bed. Since fasteners 34 simply clip to the bedclothes, apparatus 10 is suitable for use with any bedclothes without need for any modification thereof. All the while, protective means 36 protect the mattress and/or the frame from direct frictional contact with anchoring device 28 or 28'.

Figure 5:
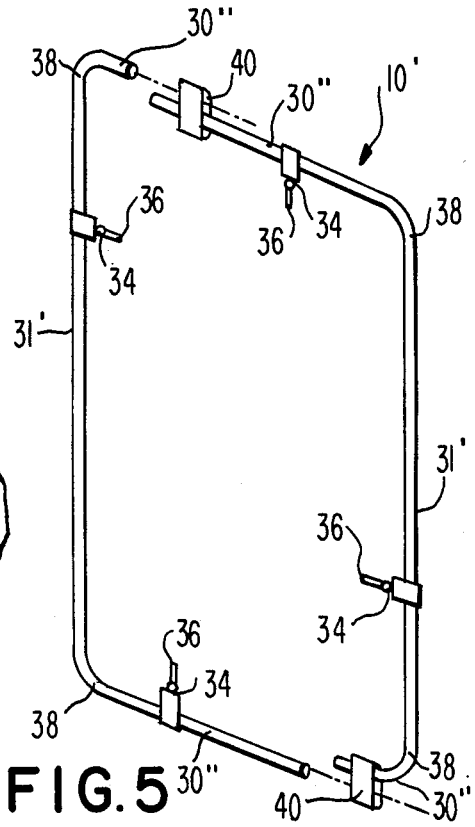
FIG. 5 is a perspective view of an alternative embodiment of an apparatus for securing bedclothes to a bed in accordance with the present invention.

If desired, rather than being formed as a single continuous piece as depicted in FIG. 2, the apparatus can be formed of two, or more, pieces fastened together in an adjustable manner to permit adjustment of the apparatus for mattresses of different sizes, e.g., king size, queen size, double size and twin size. FIG. 5 depicts such an apparatus 10' having end portions 30'' and side portions 31'. Each end of each side portion 31' extends around a corner 38 to form half a part of the adjacent end portion. The two parts of each end portion 30'' are adjustably fastened together by a coupling member 40. Fasteners 34, with protective means 36, extend from end portions 30'' and side portions 31' to hold the mattress cover and/or other bedclothes. Coupling members 40 assure maximum adjustability. Additionally, the end portion parts can be cross sectioned to permit one to fit within the other, with a holding bolt passing through an opening in each to clamp them at the desired size. Apparatus 10' can fit around the end and side surfaces of the mattress, as illustrated in FIG. 3, or beneath the mattress, as illustrated in FIG. 4.

Although the present invention has been described with reference to preferred embodiments, numerous modifications, rearrangements, and substitutions could be made, and the result would remain within the scope of the invention.

What is claimed is:

1. Apparatus for releasably securing bedclothes to a mattress having a sleeping surface, a bottom surface, and an outer periphery defined by end surfaces and side surfaces, said apparatus comprising:

a generally rectangular anchoring device adapted to contact the mattress below the sleeping surface and along the outer periphery of the mattress, said anchoring device having a pair of end portions in parallel, spaced-apart relation and adapted to contact the end surfaces of the mattress and a pair of side portions connecting said end portions in parallel, spaced-apart relation and adapted to contact the side surfaces of the mattress, said end portions and said side portions defining an inner periphery smaller than the outer periphery of the mattress, whereby said anchoring device is adapted to engage the sides of the mattress to be anchored thereon; and a plurality of fastening members, located on said anchoring device and adapted to connect said anchoring device to bedclothes in stretched-out relation over the mattress.

2. The apparatus as claimed in claim 1 further comprising protective means for preventing direct friction contact between said anchoring device and the mattress.

3. The apparatus as claimed in claim 1 wherein said fastening members are snap fasteners.

4. The apparatus as claimed in claim 1 wherein said generally rectangular anchoring device comprises a continuous annular rectangular member.

5. The apparatus as claimed in claim 1 wherein said generally rectangular anchoring device comprises at least two relatively movable members and at least two clamp members for releasably clamping said relatively movable members as said annular rectangular member of a desired size.

6. In combination with a fluid containing mattress having a sleeping surface, side surfaces and end surfaces defining an outer periphery, and a bottom surface, an apparatus for securing bedclothes to said mattress, said apparatus comprising:

a generally rectangular anchoring device contacting said mattress below said sleeping surface and along said outer periphery, said anchoring device having a pair of end portions in parallel, spaced-apart relation and contacting the end surfaces of the mattress and a pair of side portions connecting said end portions in parallel, spaced-apart relation and contacting the side surfaces of the mattress, said end portions and said side portions defining an inner periphery smaller than the outer periphery of the mattress, whereby said anchoring device is adapted to engage the sides of the mattress to be anchored thereon; and a plurality of fastening members, located on said anchoring device, and adapted to connect said anchoring device to bedclothes in stretched-out relation over said mattress.

7. The apparatus as claimed in claim 6 further comprising protective means for preventing direct frictional contact between said anchoring device and said mattress.

8. The apparatus as claimed in claim 6 wherein said fastening members are snap fasteners.

9. The apparatus as claimed in claim 6 wherein said generally rectangular anchoring device comprises a continuous annular rectangular member.

10. The apparatus as claimed in claim 6 wherein said generally rectangular anchoring device comprises at least two relatively movable members and at least two clamp members for releasably clamping said relatively movable members to permit adjustment of said annular rectangular member to a desired size.

* * * * *